US008226084B2

(12) United States Patent
Sumikura

(10) Patent No.: US 8,226,084 B2
(45) Date of Patent: Jul. 24, 2012

(54) SHEET-CONVEYING DEVICE AND IMAGE-FORMING APPARATUS INCLUDING THE SAME

(75) Inventor: Noriaki Sumikura, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 12/615,438

(22) Filed: Nov. 10, 2009

(65) Prior Publication Data

US 2010/0181717 A1 Jul. 22, 2010

(30) Foreign Application Priority Data

Jan. 22, 2009 (JP) ..... 2009-011781

(51) Int. Cl.
*B65H 5/00* (2006.01)

(52) U.S. Cl. ..... 271/264; 399/92; 399/405

(58) Field of Classification Search ..... 271/264; 399/92, 405

See application file for complete search history.

(56) References Cited

U.S. PATENT DOCUMENTS

| | | | | |
|---|---|---|---|---|
| 6,075,956 | A * | 6/2000 | Watanabe et al. | 399/92 |
| 6,775,492 | B2 * | 8/2004 | Miyakoshi et al. | 399/92 |
| 7,664,421 | B2 * | 2/2010 | Fromm | 399/92 |
| 7,726,649 | B2 * | 6/2010 | Domoto et al. | 271/195 |
| 7,937,014 | B2 * | 5/2011 | Kawamata | 399/92 |
| 2002/0186986 | A1 * | 12/2002 | Makihira | 399/92 |
| 2006/0230957 | A1 * | 10/2006 | Shimizu | 101/232 |
| 2006/0280533 | A1 * | 12/2006 | Ozawa | 399/361 |
| 2006/0285874 | A1 * | 12/2006 | Domoto et al. | 399/105 |
| 2009/0016764 | A1 * | 1/2009 | Kitozaki | 399/92 |
| 2009/0202268 | A1 * | 8/2009 | Furukawa | 399/92 |
| 2009/0252525 | A1 * | 10/2009 | Kojima | 399/92 |
| 2011/0097102 | A1 * | 4/2011 | Koshida | 399/92 |

FOREIGN PATENT DOCUMENTS

| | | | |
|---|---|---|---|
| JP | 58059875 | A * | 4/1983 |
| JP | 2000-302325 | | 10/2000 |
| JP | 2001-255807 | | 9/2001 |

* cited by examiner

*Primary Examiner* — Kaitlin S Joerger
*Assistant Examiner* — Prasad Gokhale
(74) *Attorney, Agent, or Firm* — K&L Gates LLP

(57) ABSTRACT

A sheet-conveying device designed to feed a sheet fed thereto through a fixing device toward a discharge unit includes first and second conveyance guides facing each other so as to define a sheet conveyance path and each having a conveying member designed to feed the sheet. The first conveyance guide includes a blower opening facing the sheet conveyance path for blowing air onto the sheet conveyance path, an exhaust opening provided on a downstream side in a sheet feeding direction with respect to the blower opening for removing air that has been blown onto the sheet conveyance path and discharging it outside the device.

12 Claims, 9 Drawing Sheets

SHEET-CONVEYING DEVICE AND IMAGE-FORMING APPARATUS INCLUDING THE SAME

INCORPORATION BY REFERENCE

This application is based upon and claims the benefit of priority from the corresponding Japanese Patent application No. 2009-011781, filed Jan. 22, 2009, the entire contents of which are incorporated herein by reference.

BACKGROUND

1. Field of the Invention

The present invention relates to sheet-conveying devices (post-fixation conveying devices) that are used in electrophotographic image-forming apparatuses such as copiers, printers, facsimiles, and multifunction machines having functions of the foregoing apparatuses, and to image-forming apparatuses including such sheet-conveying devices. In particular, the present invention relates to a sheet-conveying device (post-fixation conveying device) that cools sheets of paper that have had an image fixed thereto and to image-forming apparatuses including the sheet-conveying device.

2. Description of the Related Art

In general, fixation of an image to a sheet is performed at a high temperature. After the process, the temperature of the surface of the sheet remains high. While the surface temperature of the sheet is high, toner on the sheet does not completely harden and remains sticky. If image formation is successively repeated in such a state, the result is a plurality of sheets that are successively discharged and stacked onto a tray having high surface temperatures. If the toner on the sheets was not sufficiently cooled, the stacked sheets may adhere to each other due to the stickiness of the toner. Such a phenomenon is called blocking. Other potential issues may occur while the sheet is fed after fixation including feeding issues, such as jams.

Therefore, various techniques has been proposed to solve these problems. For example, an apparatus is known wherein a blower duct is provided on the downstream side in the sheet feeding direction so that the sheet is cooled immediately after fixation. The blower duct sucks in outside air using a fan and blows the air through an opening facing the sheet, whereby the sheet is cooled. The air, after it cools the sheet, flows in the sheet feeding direction together with the sheet, and is discharged to the outside.

In the above technique, however, the air that is fed from the blower duct is heated due to the high temperature of the sheet, and produces an airflow in the same direction as the sheet is being fed. This results in a hot airflow. Since the sheet is fed in this hot airflow, the sheets may not be sufficiently cooled.

To avoid such a problem, an apparatus is known wherein a sheet-cooling device that cools a sheet fed from a fixing device has a duct opening that faces the sheet from one side in the sheet width direction (a direction orthogonal to the sheet feeding direction). Cooling air is fed in the sheet width direction through the duct opening. In addition, a suction device is provided across the sheet from the sheet-cooling device. The suction device receives the cooling air that is blown from the sheet-cooling device. With such a configuration, cooling air is fed from the sheet-cooling device toward a heated sheet, in the sheet width direction, whereby the sheet is cooled. Meanwhile, the suction device removes the hot air around the sheet.

In the above technique, however, since the air is blown in the sheet width direction from the duct opening, there may be a difference in the cooling effect between an area near the duct opening and an area remote from the duct opening. That is, the sheet may not be uniformly cooled. Furthermore, blowing the air from one side in the sheet width direction and removing the air from the other side may cause the sheet to float. Moreover, since the flow rate of the air varies with the position in the sheet width direction, air turbulence may occur. This air turbulence tends to cause the sheet to float, resulting in jams in the sheet conveyance path.

SUMMARY

It is an advantage of the present invention to provide a sheet-conveying device (post-fixation conveying device) and an image-forming apparatus including same wherein paper that has had an image fixed thereto is efficiently and uniformly cooled, and the occurrences of jams are reduced. Moreover, the reduction of these jams is easily solved.

According to an embodiment of the present invention, a sheet-conveying device is provided in an apparatus including first and second conveyance guides that define a sheet conveyance path, each having a conveying member designed to feed the sheet. The first conveyance guide includes a blower opening facing the sheet conveyance path for blowing air onto the sheet conveyance path, an exhaust opening provided on a downstream side in a sheet feeding direction with respect to the blower opening for removing air that has been blown onto the sheet conveyance path and discharging it outside the device According to another embodiment of the present invention, an image-forming apparatus including the sheet-conveying device in a body of the apparatus and designed to feed a sheet fed thereto through a fixing device toward a discharge unit is provided.

Additional features and advantages are described herein, and will be apparent from the following Detailed Description and the figures.

DETAILED DESCRIPTION

Embodiments of the present invention will now be described with reference to the accompanying drawings. It should be noted that the present invention is not limited to the following embodiments. It should also be noted that applications of the present invention and terms and the like used herein are not limited to those described below.

Figure 1:
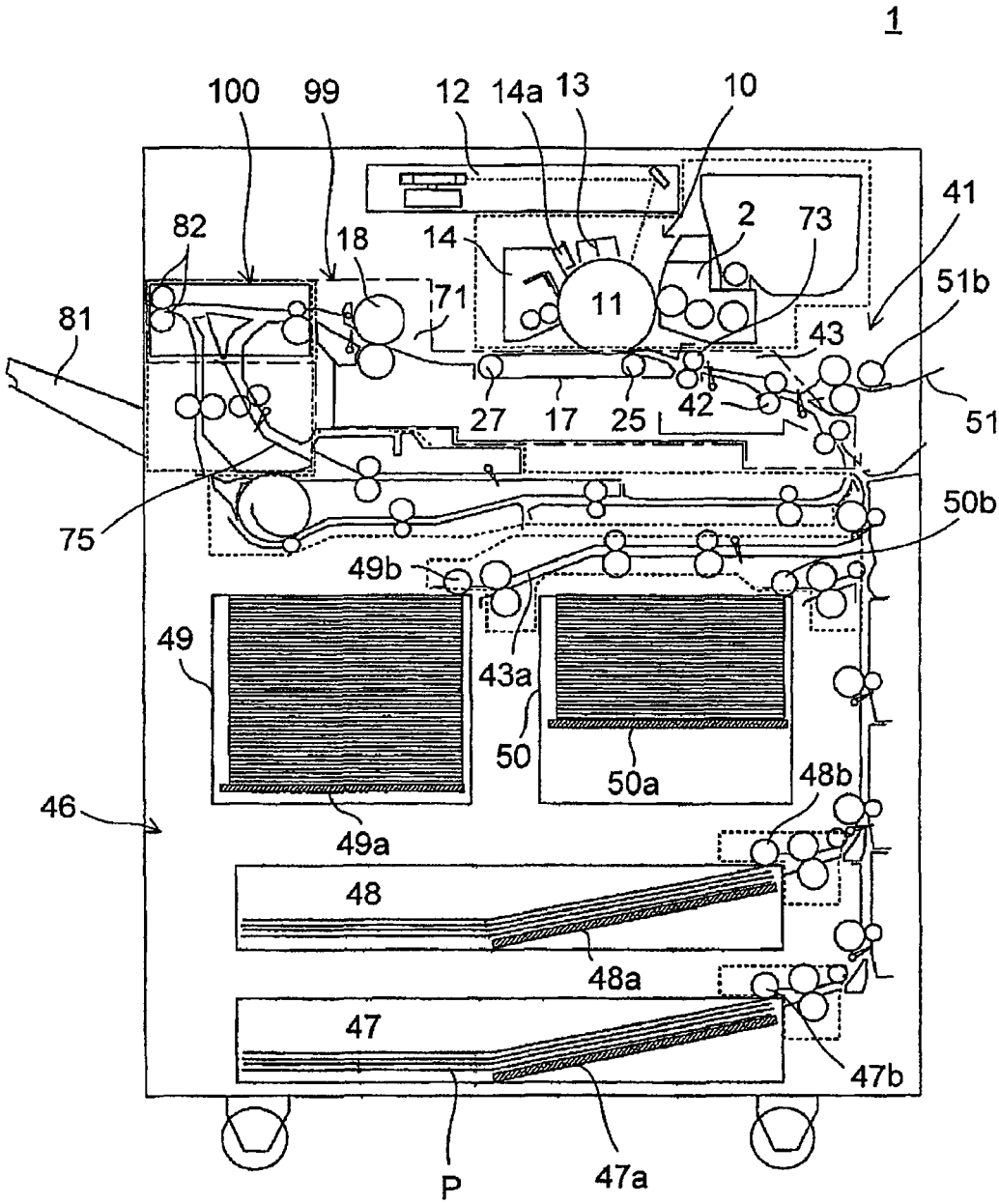
FIG. 1 is a schematic front view of an image-forming apparatus according to an embodiment of the present invention.

FIG. 1 is a schematic front view showing the internal design of an image-forming apparatus according to an embodiment of the present invention. The image-forming apparatus 1 has a rectangular housing and includes the following elements that are housed therein. An image-forming section 10 is provided in an upper part of the housing. The image-forming section 10 includes a photoreceptor 11, a developer 2, a charger 13, a cleaner 14, and a static eliminator 14*a*. The photoreceptor 11 is rotatable and has a photosensitive layer made of amorphous-silicon photosensitive material or organic photoconductor (OPC). The photoreceptor 11 is surrounded by the developer 2, an exposure unit 12, the charger 13, the cleaner 14, and the static eliminator 14*a*. The developer 2 includes a developing roller, a toner container, etc. The exposure unit 12 applies a laser beam on the photoreceptor 11 based on a document image data that is inputted to an image input unit (not shown) from a personal computer or the like.

A transfer-conveyance belt 17 is stretched between a transfer roller 25 and a follower roller 27. The transfer roller 25 is positioned so as to face the photoreceptor 11 with the transfer-conveyance belt 17 being interposed therebetween.

When an image-forming operation is initiated, the photoreceptor 11 rotates clockwise in FIG. 1, the charger 13 uniformly charges the surface of the photoreceptor 11, and the exposure unit 12 applies a laser beam to the surface of the photoreceptor 11 based on the image data. An electrostatic latent image is thereby formed on the surface of the photoreceptor 11. Subsequently, a development bias applied to the developing roller of the developer 2 causes toner to adhere to the electrostatic latent image on the surface of the photoreceptor 11, forming a toner image.

The toner image on the surface of the photoreceptor 11 is transferred by the transfer roller 25 that is charged with a transfer bias (having a polarity opposite to that of the charged toner), onto a sheet that is carried and fed by the transfer-conveyance belt 17.

Residual toner that has not been transferred onto the sheet and remains on the photoreceptor 11 is removed by the cleaner 14. Residual charge remaining on the photoreceptor 11 is eliminated by the static eliminator 14*a*.

The sheet-feeding section 46 includes sheet cassettes 47 and 48, large-capacity decks 49 and 50, etc. The sheet cassettes 47 and 48 are located at the bottom of the housing at vertically different levels, and store sheets P therein on plates 47*a* and 48*a*, respectively. The large-capacity decks 49 and 50 are positioned above the sheet cassette 48 at horizontally different positions, and store sheets P therein on plates 49*a* and 50*a*, respectively. The sheet-feeding section 46 also includes pickup rollers 47*b* to 50*b* at upper right positions of the sheet cassettes 47 and 48 and the large-capacity decks 49 and 50, respectively, so that the sheets P on the plates 47*a* to 50*a* are fed into a sheet conveyance path one at a time. In addition, a manual feed tray 51 for individually feeding paper is provided on the right side face of the housing, together with a pickup roller 51*b* causing sheets P thereon to be fed one at a time into the sheet conveyance path.

A sheet-conveying section 41 is responsible for feeding each of the sheets P in the image-forming apparatus 1, and includes a feed path 43, an image formation path 71, and a two-sided-printing path 75. A portion of the feed path 43 and the image formation path 71 are included in the sheet-conveying unit 99 defined by alternate long and short dashed lines in FIG. 1.

The feed path 43 extends vertically, on the right side of the housing, from the sheet-feeding section 46, i.e., from the sheet cassette 47, to the transfer roller 25. The feed path 43 joins, sequentially upward from the sheet cassette 47, a conveyance path extending from the sheet cassette 48, a conveyance path extending from the large-capacity deck 50, and a conveyance path 43*a* extending from the large-capacity deck 49. The feed path 43 is provided with a plurality of pairs of conveying rollers 42 and a registration roller 73. The registration roller 73 is located before the transfer roller 25 and controls the timing of the feeding of the sheet P.

The image formation path 71 extends from right to left in the housing, from the transfer roller 25 through a fixing device 18 to discharge rollers 82 with which the sheet P having an image is discharged. A sheet-conveying device 100, which will be described separately below, is provided in the image formation path 71.

The two-sided-printing path 75 is intended for a situation where, after an image is fixed on a sheet P by the fixing device 18, another image is to be formed on the back of the sheet P, according to need, by turning over the sheet P. The two-sided-printing path 75 branches off from the image formation path 71 at a downstream position thereof in a sheet feeding direction with respect to the fixing device 18, extends below the image formation path 71 from left to right, and ultimately joins the feed path 43 at a position above the conveyance path 43*a* extending from the large-capacity deck 49.

Each of the sheets P fed from the sheet-feeding section 46 is fed upwardly along the feed path 43. The sheet P is further fed to the transfer roller 25 at a time interval that is controlled by the registration roller 73. Then, a toner image is transferred onto the sheet P by the transfer roller 25. The sheet P carrying the toner image is further fed along the image formation path 71 to the fixing device 18, and is heated and pressed by a fixing roller and a heating roller included in the fixing device 18. The toner image is thereby fused and fixed onto the sheet P. The sheet P, that has undergone fixation, is then fed through the sheet-conveying device 100 and is discharged to a discharge tray 81, by the discharge rollers 82.

When it is desired to perform two-sided printing, the sheet P that has undergone fixation by the fixing device 18 is fed through the sheet-conveying device 100 to the two-sided-printing path 75, is turned over, and is fed back to the feed path 43. Then, a toner image is transferred onto the back of the sheet P, by the image-forming section 10, and is fused and fixed thereto by the fixing device 18. Subsequently, the sheet P is fed through the sheet-conveying device 100 and is discharged onto the discharge tray 81.

Figure 2:
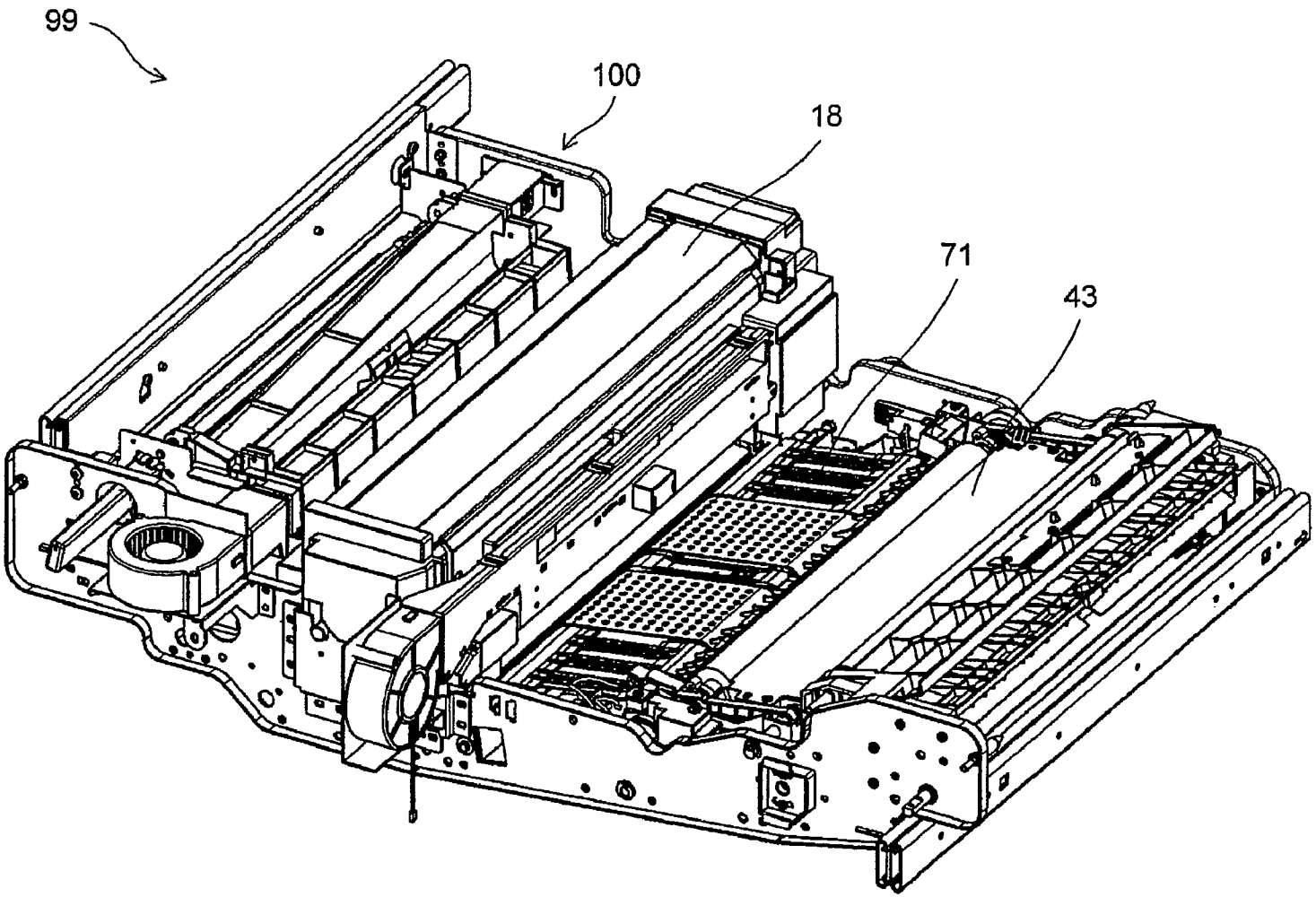
FIG. 2 is a perspective view of a sheet-conveying unit in an image-forming apparatus according to an embodiment of the present invention.
Figure 3:
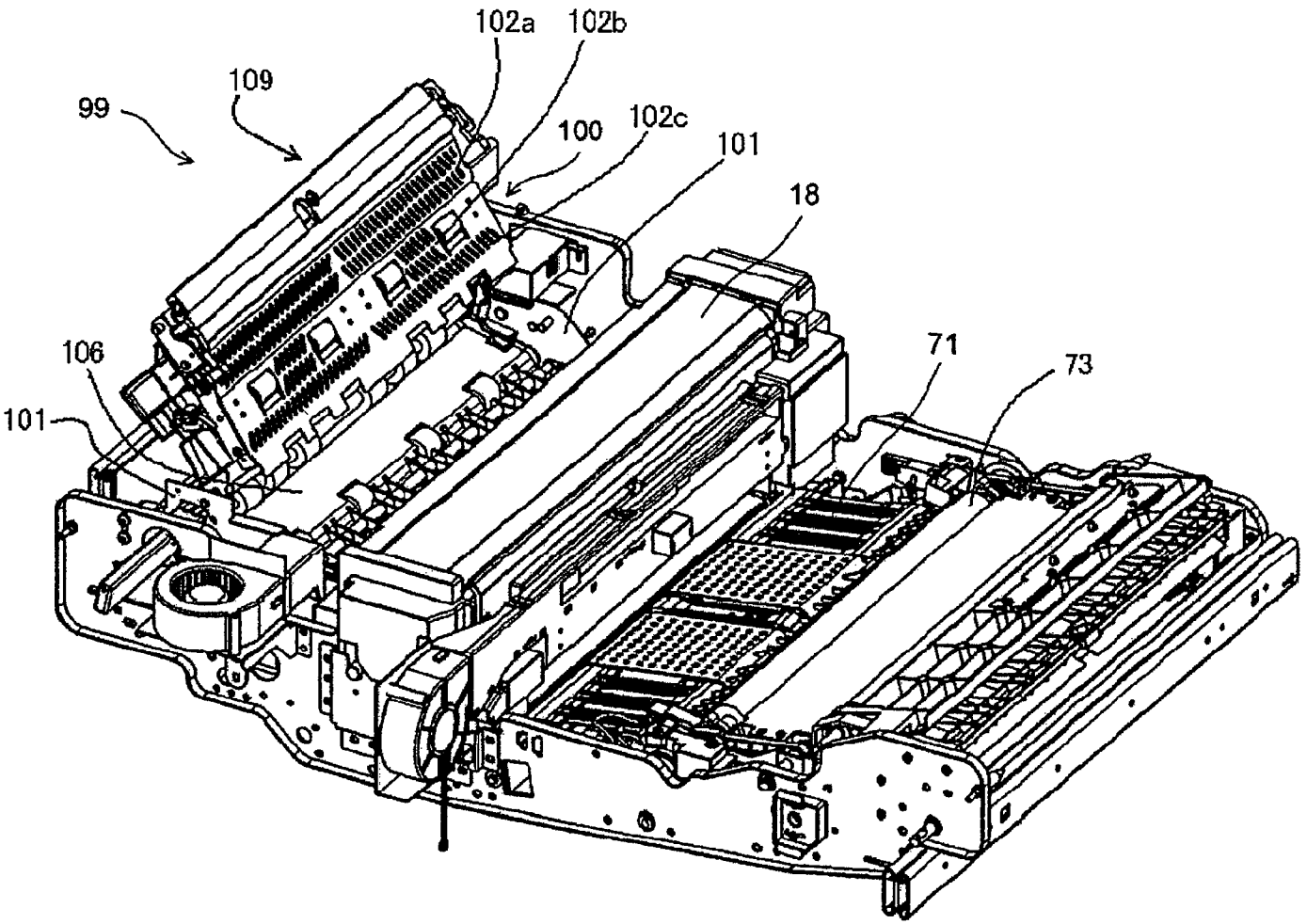
FIG. 3 is a perspective view of the sheet-conveying unit according to an embodiment of the present invention, in a state where a sheet conveyance path is exposed.

FIG. 2 is a perspective view of the sheet-conveying unit 99. FIG. 3 shows the sheet-conveying unit 99 with the sheet-conveying device 100 opened. The image formation path 71 includes a portion of the feed path 43, a transfer conveyor including the transfer roller 25, the fixing device 18, and the sheet-conveying device 100 included in the sheet-conveying unit 99. The sheet-conveying unit 99 can be pulled, in the forward direction in FIG. 1, out of and inserted into the image-forming apparatus 1 along guide rails (not shown) provided in the image-forming apparatus 1. If a sheet becomes jammed in the sheet-conveying device 100, the sheet-conveying unit 99 is pulled out of the image-forming apparatus 1 along the guide rails, and an upper conveying member (first conveyance guide) 109 included in the sheet-conveying device 100 is rotated so that a post-fixation sheet conveyance path 106 is exposed as shown in FIG. 3. In this position, the jam can be removed. After the jam is removed, the upper conveying member (first conveyance guide) 109 is rotated and closed, and the sheet-conveying unit 99 is inserted into the image-forming apparatus 1 along the guide rails.

Figure 4:
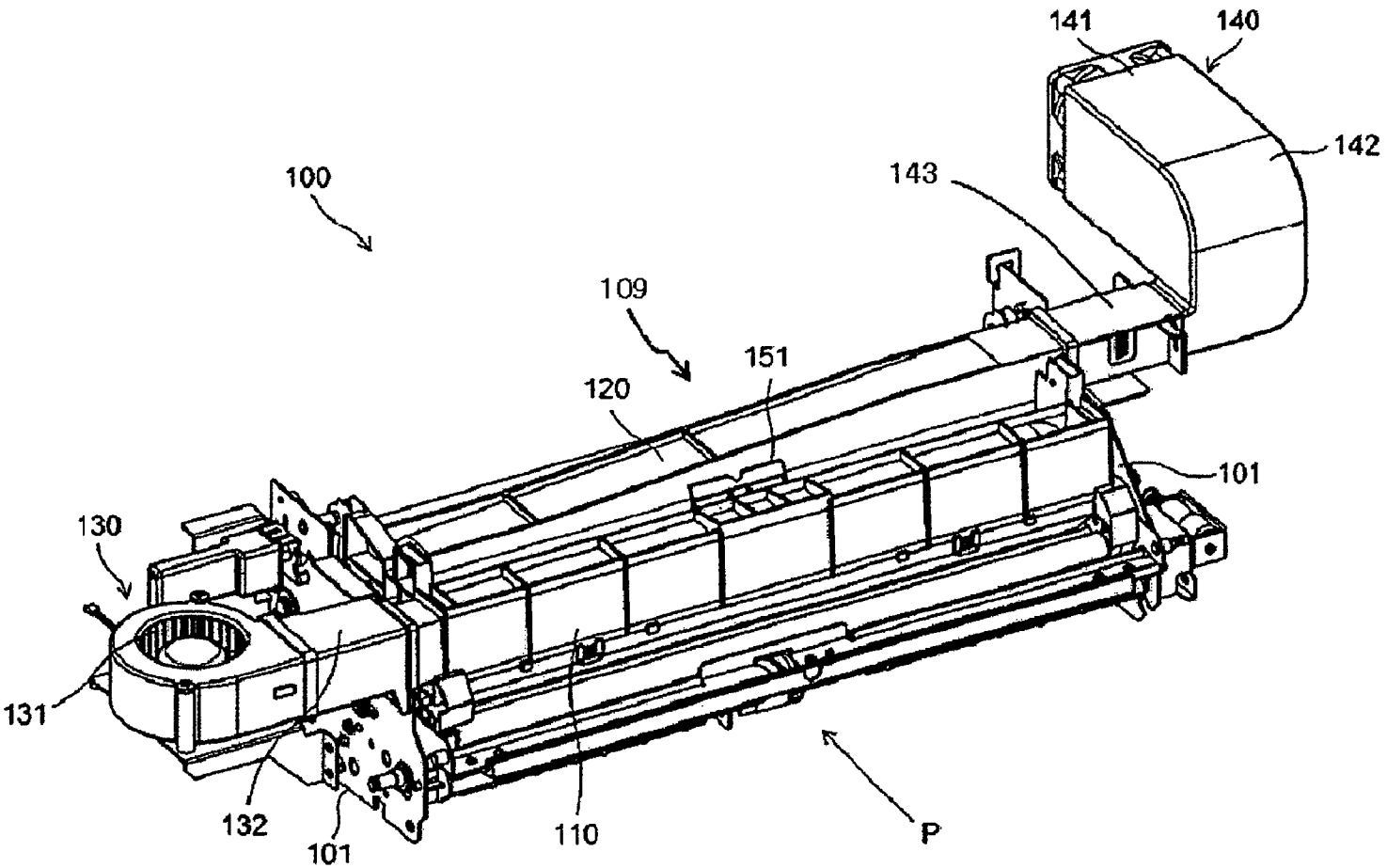
FIG. 4 is a perspective view of an upper conveying member of a sheet-conveying device according to an embodiment of the present invention.
Figure 5:
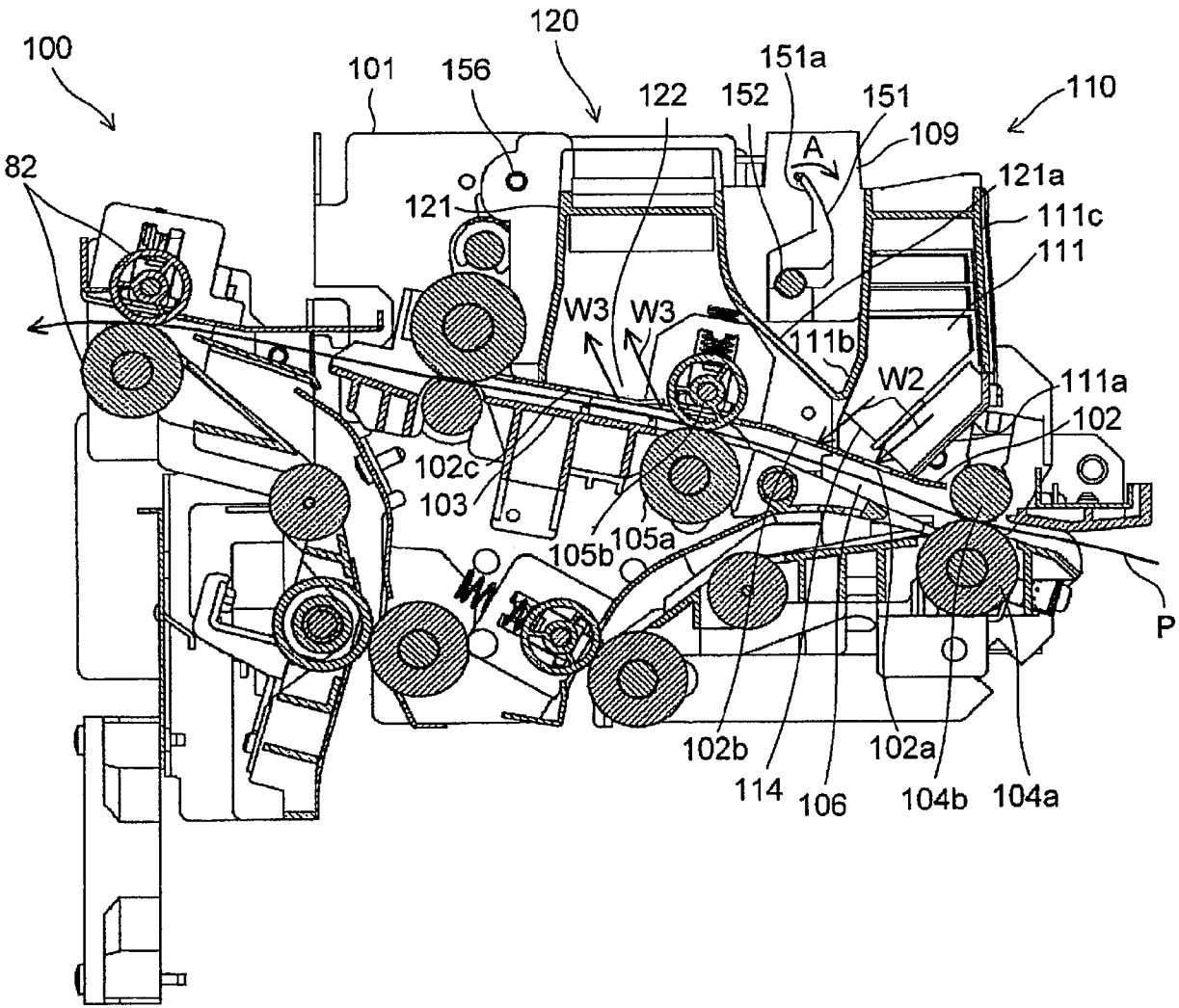
FIG. 5 is a cross-sectional view of the sheet-conveying device according to an embodiment of the present invention.
Figure 6:
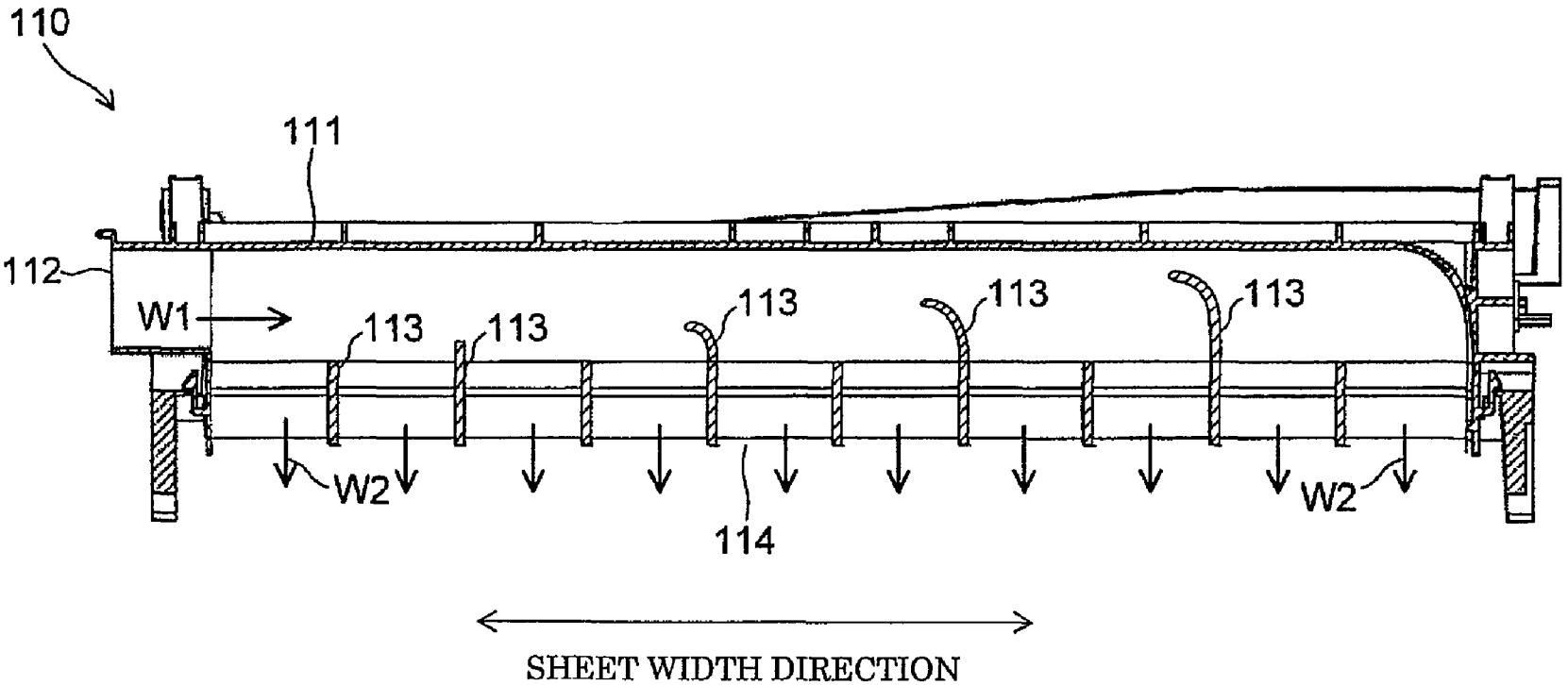
FIG. 6 is a longitudinal sectional view of a blower duct, included in the sheet-conveying device, according to an embodiment of the present invention.
Figure 7:
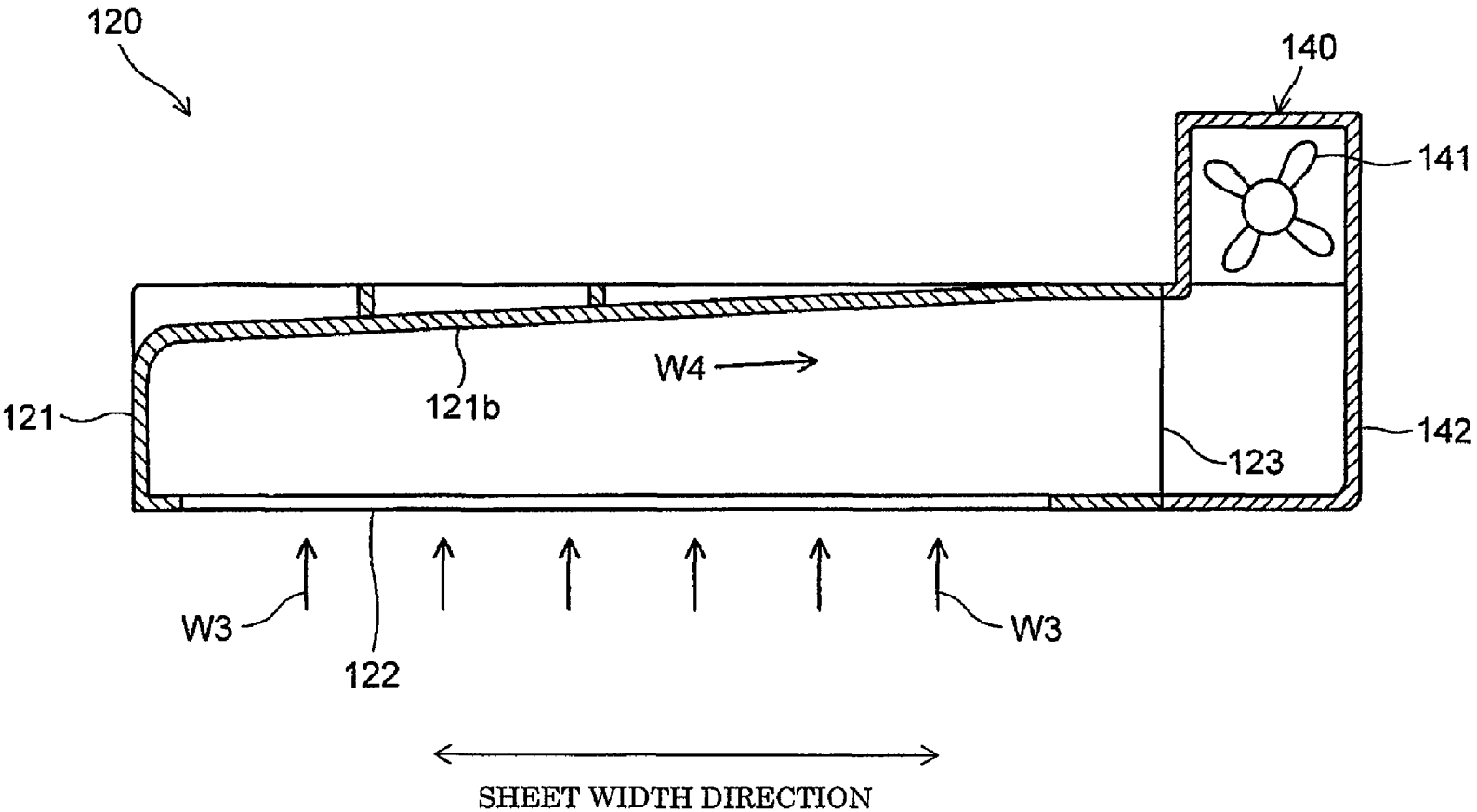
FIG. 7 is a schematic longitudinal sectional view of an exhaust duct, included in the sheet-conveying device, according to an embodiment of the present invention.

The sheet-conveying device 100 will now be described. FIG. 4 is a perspective view of the upper conveying member (first conveyance guide) 109 of the sheet-conveying device 100 included in the sheet-conveying unit 99 according to an embodiment of the present invention. FIG. 5 is a cross-sectional view of the sheet-conveying device 100. FIG. 6 is a longitudinal sectional view of a blower duct 110 included in the upper conveying member (first conveyance guide) 109. FIG. 7 is a schematic longitudinal sectional view of an exhaust duct 120 included in the upper conveying member (first conveyance guide) 109.

Referring to FIG. 4, the sheet-conveying device 100 includes side support plates 101 and the upper conveying member (first conveyance guide) 109. The side support plates 101 form a part of the sheet-conveying unit 99. The upper conveying member (first conveyance guide) 109 is rotatably attached to the frame of the sheet-conveying unit 99, and has, a rear side thereof, the blower duct 110 and exhaust duct 120. In a situation where the post-fixation sheet conveyance path 106 is covered, the upper conveying member (first conveyance guide) 109 is connected to an intake fan unit 130, that is included in the sheet-conveying unit 99, and an exhaust fan unit 140, that is attached to the body of the image-forming apparatus 1, through respective connection ducts 132,143.

A release lever 151, provided substantially at the center in a sheet width direction between the blower duct 110 and the exhaust duct 120, allows the upper conveying member (first conveyance guide) 109 to turn. This allows the post-fixation sheet conveyance path 106 to be exposed or covered.

The intake fan unit 130 includes an intake fan 131, which is in an embodiment a sirocco fan, and the connection duct 132 through which air taken in by the intake fan 131 is guided to the blower duct 110.

The blower duct 110, which has a rectangular shape, blows the air taken in by the intake fan 131 toward the sheet P, so that the sheet P is cooled. The blower duct 110 extends in the sheet width direction, which is orthogonal to the direction (represented by the arrow in FIG. 4) in which the sheet P is fed. The length of the blower duct 110, in the sheet width direction, is set so as to match the maximum width of sheets to be used.

The exhaust duct 120, which has a rectangular shape, takes in the air, which has been heated after cooling the sheet. The exhaust duct 120 extends in the sheet width direction parallel to the blower duct 110. The length of the exhaust duct 120, in the sheet width direction, is also set so as to match the maximum width of sheets to be used, as is that of the blower duct 110.

The exhaust fan unit 140 includes a duct 142 communicating with the exhaust duct 120 and an exhaust fan 141 that draws the hot air through the duct 142 and discharges the hot air outside.

The side support plates 101 are located inside respective side plates of the sheet-conveying unit 99, at ends, in the sheet width direction, of the blower duct 110 and the exhaust duct 120. One of the side support plates 101 secures and supports the connection duct 132 on the outside thereof. The other side support plate 101 secures and supports the connection duct 143 on the outside thereof. The upper conveying member (first conveyance guide) 109 is pivotably held between the two side support plates 101.

The upper conveying member (first conveyance guide) 109 includes the blower duct 110 and the exhaust duct 120, provided as an integral body, and the release lever 151, which functions as a handle. When the release lever 151 is moved, the upper conveying member (first conveyance guide) 109 pivots about the side support plates 101, exposing the post-fixation sheet conveyance path 106. That is, the intake fan unit 130 and the blower duct 110 are removably connectable to each other, and the exhaust fan unit 140, attached to the body of the image-forming apparatus 1, and the exhaust duct 120 are connectable to each other. The design and operation of the release lever 151 will be described below.

Referring to FIG. 5, the upper conveying member (first conveyance guide) 109 will now be described. The upper conveying member (first conveyance guide) 109 includes the blower duct 110, the exhaust duct 120, and an upper conveyance guide plate 102, corresponding to an upper conveyance guide member. The post-fixation sheet conveyance path 106 is provided by the upper conveyance guide plate 102 and a lower conveyance guide plate 103 that faces the upper conveyance guide plate 102. The upper conveyance guide plate 102 is integrally provided with other components that are included in the upper conveying member (first conveyance guide) 109. The lower conveyance guide plate 103 is secured to and supported by the side support plates 101. The post-fixation sheet conveyance path 106 inclines upwardly from the side of the fixing device 18 (not shown but provided on the right side in FIG. 5) toward the discharge roller 82. The sheet P is fed along the sloping post-fixation sheet conveyance path 106 (as represented by the arrow P in FIG. 5).

The upper conveyance guide plate 102 has a line of blowholes 102*a* corresponding to blower openings, a line of vent holes 102*b* corresponding to ventilation openings, and a line of exhaust holes 102*c* corresponding to exhaust openings, the line of holes extending in the sheet width direction (the depth direction in FIG. 5) and being arranged side by side in the sheet feeding direction. The blowholes 102*a* are slits each extending in the sheet feeding direction and are arranged along the blower duct 110. The exhaust holes 102*c* are also slits each extending in the sheet feeding direction and are arranged along the exhaust duct 120. The vent holes 102*b* are round holes lined up between the line of the blowholes 102*a* and the line of the exhaust holes 102*c* in the sheet feeding direction and arranged between a plurality of conveying rollers provided in the sheet width direction at specific intervals. This thereby facilitates the airflow from the blower duct 110 to the exhaust duct 120, as shown in FIG. 5.

In the post-fixation sheet conveyance path 106, conveying rollers 104*a*, 104*b*, 105*a*, and 105*b* are provided. The conveying rollers 105*a* and 105*b* are positioned on the downstream side in the sheet feeding direction with respect to the conveying rollers 104*a* and 104*b*. The conveying rollers 104*a*, 104*b*, 105*a*, and 105*b* feed the sheet P toward the discharge roller 82. The conveying rollers 104*b* and 105*b* are rotatably held by the upper conveyance guide plate 102 and are included in the upper conveying member (first conveyance guide) 109. The conveying rollers 104*a* and 105*a* are rotatably held by the side support plates 101 and included, together with the lower conveyance guide plate 103, in a lower conveying member (second conveyance guide).

Referring to FIG. 6, the blower duct 110 includes an inlet port 112 (facing the connection duct 132 of the intake fan unit 130 (see FIG. 4)), a blower duct body 111 (extending from the inlet port 112 in the sheet width direction), louvers 113 (provided inside the blower duct body 111), and openings 114 through which the air is fed toward the sheet P.

The inlet port 112 is removably connectable to the connection duct 132 of the intake fan unit 130 (see FIG. 4). When the inlet port 112 is connected to the connection duct 132, an airflow W1 is fed into the blower duct body 111 from the connection duct 132. The connection between the inlet port 112 and the connection duct 132 is sealed, when connected, using, for example, a sponge material that is provided therearound, preventing air leakage.

The louvers 113, provided inside the blower duct body 111, are located in the sheet width direction at specific intervals. The louvers 113 individually change the direction of the airflow W1 by 90 degrees and produce airflows W2 flowing through the respective openings 114 toward the sheet P. This results in the airflows W2 becoming uniform in the sheet width direction. The louvers 113 are plates that each extend in the sheet feeding direction inside the blower duct body 111 and integrally provided with the blower duct body 111. The lengths of the louvers 113 are shorter on the upstream side of the airflow W1, and gradually lengthen upwardly toward the downstream side, with the tips thereof being curved.

Referring to FIG. 5, the blower duct body 111 has a box-like shape projecting upwardly from the upper conveyance guide plate 102. Upstream and downstream walls 111*a* and 111*b* of the blower duct body 111 partially form sloping surfaces near the upper conveyance guide plate 102. Specifically, they slope toward the downstream side in the sheet feeding direction and form an angle greater than 90 degrees with respect to the upper conveyance guide plate 102 (in an embodiment, the wall 111*a* forms an angle of about 105 degrees, and the wall 111*b* forms an angle of about 95 degrees). Accordingly, the airflows W2 fed through the openings 114 flows from the upstream side toward the downstream side in the sheet feeding direction, passing through the blow-holes 102*a* and the vent holes 102*b*, and contacting the sheet P on the post-fixation sheet conveyance path 106, thereby cooling the sheet P.

The exhaust duct 120 includes an exhaust duct body 121 and a duct space 122 into which the air that has been heated is drawn.

The exhaust duct body 121 projects upwardly from the upper conveyance guide plate 102. A wall 121*a* of the exhaust duct body 121 on the upstream side in the sheet feeding direction slopes toward the upstream side in the sheet feeding direction and forms an angle less than 90 degrees (about 30 degrees in an embodiment) with respect to the upper conveyance guide plate 102, and is connected to the wall 111*b* of the blower duct body 111. Therefore, airflows W3, resulting from the cooling of the sheet P flow from the upstream side toward the downstream side in the sheet conveyance direction, pass through the exhaust holes 102*c*, and are drawn into the duct space 122.

Referring to FIG. 7, the exhaust duct body 121 of the exhaust duct 120 extends in the sheet width direction and guides the air that has become heated after cooling the sheet toward the exhaust fan unit 140. A top face 121*b* of the exhaust duct body 121 forms a sloping surface sloping upwardly toward the exhaust fan unit 140. Since the airflows W3 drawn in through the exhaust holes 102*c* are hot, the airflows W3 flow upwardly inside the exhaust duct body 121 and produce an airflow W4. The airflow W4 flows along the sloping surface formed by the top face 121*b* toward the exhaust fan unit 140. The cross-sectional area of the passageway of the airflow provided in the exhaust duct body 121 is set to be larger than that provided in the blower duct body 111 (see FIG. 6).

The exhaust fan unit 140 includes the exhaust fan 141, which is a propeller fan, and duct 142.

The duct 142 and exhaust duct 120 are connected to each other via connection duct 143 that is located therebetween. The connection duct 143 is removably connectable to the exhaust duct 120. Where the exhaust duct 120 is connected to the connection duct 143, the airflow W4 produced in the exhaust duct 120 is received by the exhaust fan 141 and is discharged through the duct 142 outside of the sheet-conveying unit 99. The connection between the connection duct 143 and the exhaust duct 120 is sealed, when connected, with, for example, a sponge material that is provided therearound, preventing air leakage.

Figure 8:
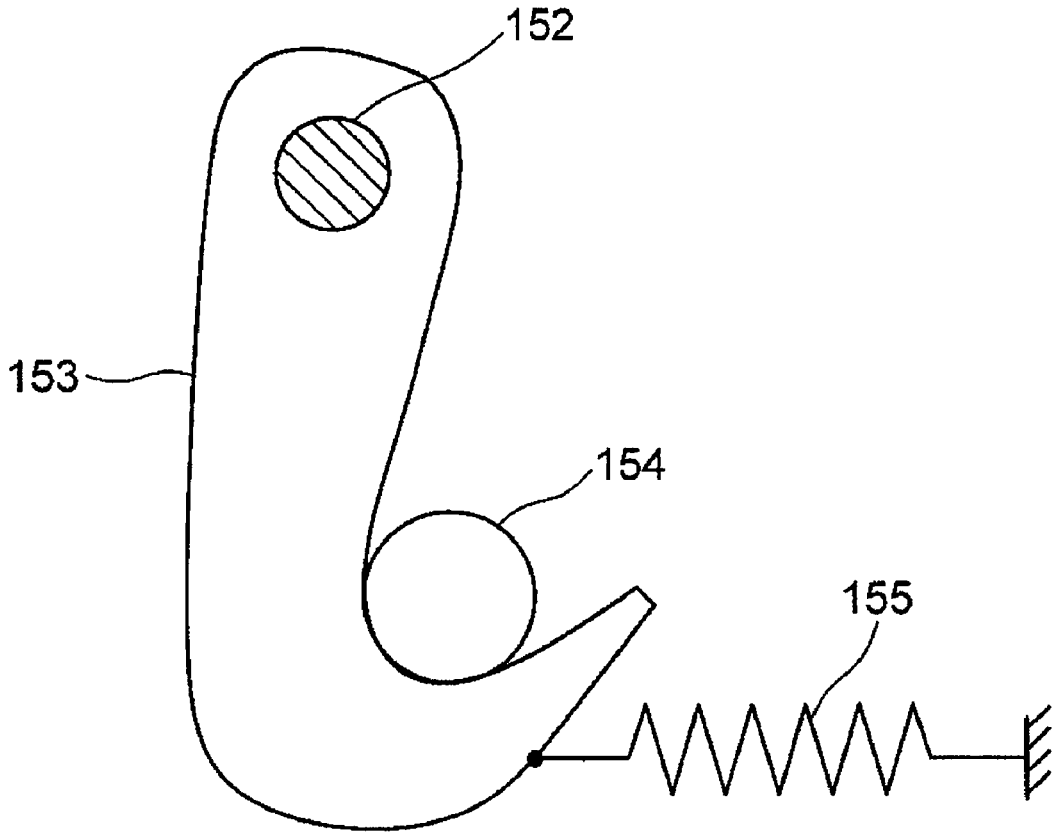
FIG. 8 schematically shows a mechanism of opening and closing the upper conveying member of the sheet-conveying device according to an embodiment of the present invention.
Figure 9:
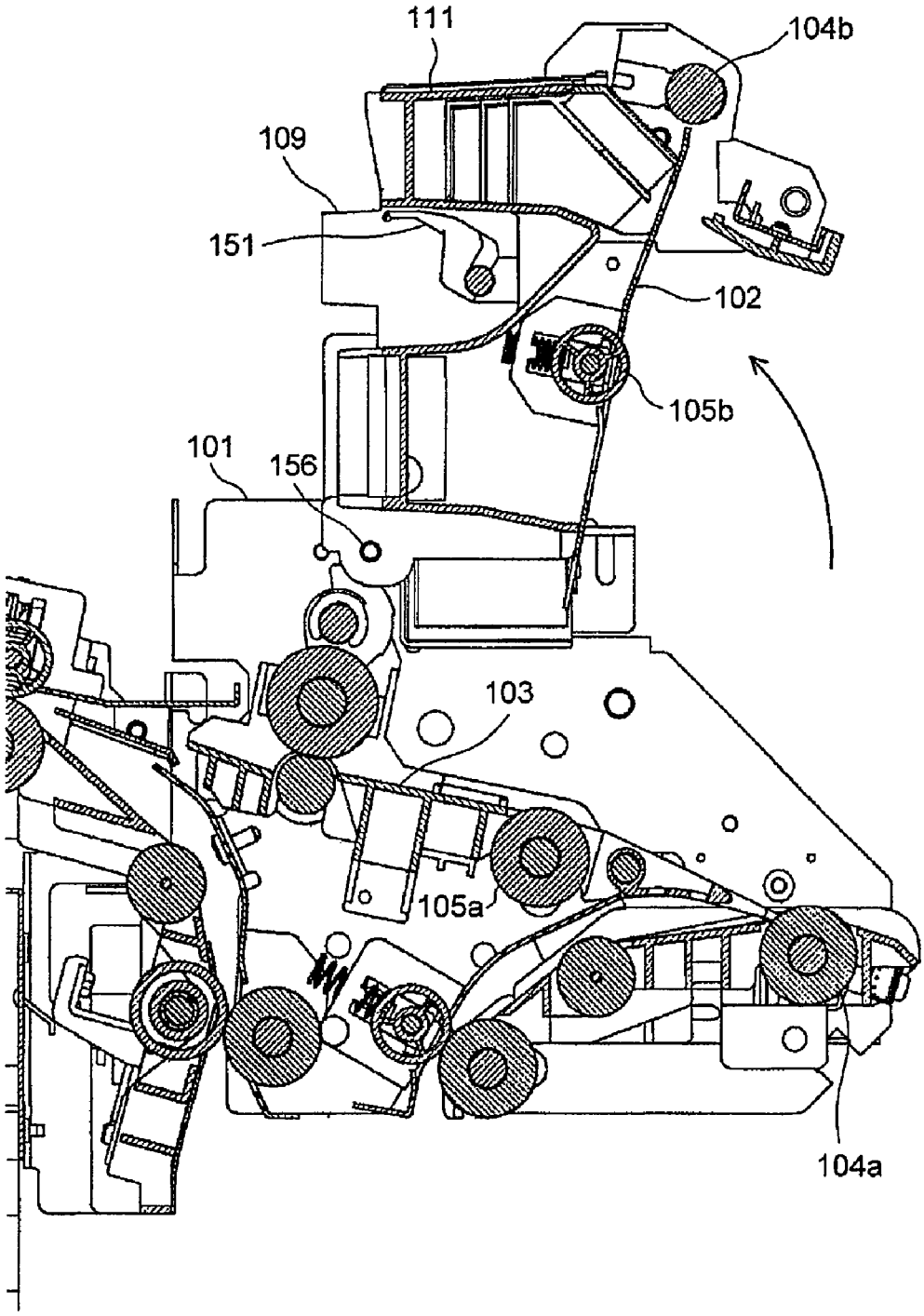
FIG. 9 is a cross-sectional view showing the upper conveying member of the sheet-conveying device according to an embodiment of the present invention opened.

A design and method for clearing jams will now be described with reference to FIGS. 2, 5, 8, and 9. FIG. 8 schematically shows a mechanism for exposing and covering the post-fixation sheet conveyance path 106. FIG. 9 is a cross-sectional view showing the post-fixation sheet conveyance path 106 exposed.

As described above referring to FIG. 5, the side support plates 101 support the lower conveyance guide plate 103 and the conveying rollers 104*a* and 105*a*. The upper conveying member (first conveyance guide) 109 is provided with the blower duct 110, the exhaust duct 120, the release lever 151, the upper conveyance guide plate 102, and the conveying rollers 104*b* and 105*b*. The upper conveying member (first conveyance guide) 109 is rotatably held by a rotational shaft 156 supported by the side support plates 101.

The release lever 151, which is movable, is located between the blower duct 110 and the exhaust duct 120. The release lever 151 is used to expose the post-fixation sheet conveyance path 106 so that if a sheet P jams, in the post-fixation sheet conveyance path 106 it can be removed. By providing the release lever 151 between the blower duct 110 and the exhaust duct 120, an increase in the size of the image-forming apparatus 1 is prevented.

The release lever 151 is positioned at the center in the sheet width direction (see FIG. 4) and is secured to a shaft 152. The release lever 151 can be moved using the handle 151*a* provided at one end thereof on the side remote from the shaft 152. The shaft 152 extends in the sheet width direction and is rotatably supported at ends thereof by the upper conveying member (first conveyance guide) 109.

Referring to FIG. 8, the shaft 152 is provided with locking levers 153 secured at ends thereof in the sheet width direction. The locking levers 153 are each engageable with a locking shaft 154 provided on corresponding side support plates 101, and are each urged by a spring 155 in a direction as to engage with the locking shaft 154. When the upper conveying member (first conveyance guide) 109 is closed, the locking levers 153 engage with the respective locking shafts 154, and the upper conveyance guide plate 102 faces the lower conveyance guide plate 103, whereby the post-fixation sheet conveyance path 106 is provided (see FIG. 5).

To clear a jam, the sheet-conveying unit 99, shown in FIG. 2, is pulled out of the image-forming apparatus 1 along the guide rails. This exposes the sheet-conveying device 100 to the outside of the image-forming apparatus 1. In this state, the release lever 151 can be moved. Subsequently, referring to FIG. 5, a finger can be pressed against a right sidewall 111*c* of the blower duct body 111 while another finger is pressed against the handle 151*a* of the release lever 151. The release lever 151 is then turned in the direction represented by the arrow A (clockwise). Thus, the locking levers 153 turn clockwise against the urging force of the springs 155 and disengage from the locking shafts 154 (see FIG. 8).

Subsequently, the right sidewall 111*c* of the blower duct body 111 and the handle 151 a of the release lever 151 that can be pinched by the fingers are raised. Then, the upper conveying member (first conveyance guide) 109 turns counterclockwise about the rotational shaft 156, as shown in FIG. 9. When the upper conveying member (first conveyance guide) 109 is turned, the upper conveyance guide plate 102 and the conveying rollers 104*b* and 105*b* move away from the lower conveyance guide plate 103 and the conveying rollers 104*a* and 105*a*. Thus, the post-fixation sheet conveyance path 106 is exposed, and the jam can be cleared.

According to an embodiment, the sheet P is fed along the post-fixation sheet conveyance path 106 while the air received from the outside of one of the side support plates 101 into the blower duct body 111 of the blower duct 110 is fed through all the blowholes 102*a* simultaneously in the sheet width direction, cooling the sheet P. The air that has heated from cooling the sheet P is drawn into all the exhaust holes 102*c* simultaneously in the sheet width direction on the downstream side in the sheet feeding direction with respect to the blowholes 102*a*, and is discharged through the exhaust duct body 121 of the exhaust duct 120 outside of the other side support plate 101. Thus, the sheet P is efficiently and uniformly cooled and is fed smoothly, whereby the occurrences of jams are suppressed.

According to an embodiment, the air fed from the blowholes 102*a* toward the post-fixation sheet conveyance path 106 flows along a path sloping toward the downstream side, in the sheet feeding direction, and therefore pushes the sheet P in the sheet feeding direction. Thus, the sheet P is fed smoothly.

According to an embodiment, the air drawn from the post-fixation sheet conveyance path 106 into the exhaust holes 102*c* flows along a path sloping toward the downstream side in the sheet feeding direction and therefore acts on the sheet P in the sheet feeding direction. Thus, the sheet P is fed smoothly.

According to an embodiment, the exhaust duct 120 includes the exhaust duct body 121 and an outlet port 123 provided at one end in the sheet width direction and communicating with the exhaust fan 141. The exhaust duct body 121 has a sloping surface (the top face 121*b*) sloping upwardly toward the outlet port 123. Since the air drawn through the exhaust holes 102*c* is heated, the hot air moves upward in the exhaust duct body 121 and flows along the sloping surface formed by the top face 121*b* toward the exhaust fan 141. Thus, the hot air is quickly discharged, and the sheet P is efficiently cooled.

According to an embodiment, the cross-sectional area of the air passageway in the blower duct body 111 is smaller than that of the exhaust duct body 121. Therefore, the flow rate of the air passing through the blower duct body 111 is greater than the air passing through the exhaust duct body 121. This causes an increased flow rate in airflow through the blowholes 102*a*. Thus, the sheet P is efficiently cooled in a short period of time. Moreover, since the cross-sectional area of the exhaust duct body 121 is large, the heated air is assuredly discharged.

According to an embodiment, the line of the vent holes 102*b* is provided between the line of the blowholes 102*a* and the line of the exhaust holes 102*c* in the sheet feeding direction. Thus, the air in the blower duct 110 is fed through both the blowholes 102*a* and the vent holes 102*b*, whereby the sheet P is assuredly cooled.

According to an embodiment, the upper conveying member (first conveyance guide) 109 is pivotably supported by the side support plates 101, the blower duct 110 projects from the upper conveyance guide plate 102, and the release lever 151 is located near the blower duct 110. Therefore, if a sheet jam occurs in the post-fixation sheet conveyance path 106, the jam can be cleared as follows. The release lever 151 is moved in an open direction, and subsequently the blower duct 110 and the release lever 151 are pinched, using fingers, and are raised. This causes the upper conveying member (first conveyance guide) 109 to turn about the side support plates 101, and the post-fixation sheet conveyance path 106 to be exposed. This prevents the need to increase the size of the apparatus, and feeding issues, such as jams, if any, are solved by a simple operation.

According to an embodiment, the release lever 151 is located between the blower duct 110 and the exhaust duct 120, specifically, near the blower duct 110. The present invention is not limited to such a design. The release lever 151 may alternatively be located near the exhaust duct 120, between the blower duct 110 and the exhaust duct 120. In that case, a jam is cleared by moving the release lever 151 in the open direction, and subsequently pinching and raising the exhaust duct 120 and the release lever 151. If the release lever 151 is located near the blower duct 110, the release lever 151 may alternatively be provided on the upstream side in the sheet feeding direction with respect to the blower duct 110. If the release lever 151 is located near the exhaust duct 120, the release lever 151 may alternatively be provided on the downstream side in the sheet feeding direction with respect to the exhaust duct 120.

The present invention can be used in sheet-conveying devices (post-fixation conveying devices) included in image-forming apparatuses such as copiers, printers, facsimiles, and multifunction machines having functions of the foregoing apparatuses, and image-forming apparatuses including the sheet-conveying devices. In particular, the present invention can be used in a sheet-conveying device (post-fixation conveying device) that cools a sheet that has undergone fixation, and an image-forming apparatus including the sheet-conveying device.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A sheet-conveying device for feeding a sheet of paper, comprising:

first and second conveyance guides that define a sheet conveyance path, each having a conveying member designed to feed the sheet, the first conveyance guide includes a blower opening facing the sheet conveyance path for blowing air into the sheet conveyance path;

an exhaust opening provided on a downstream side in a sheet feeding direction with respect to the blower opening for removing air that has been blown into the sheet conveyance path and discharging it outside the device;

a ventilation opening provided between the blower opening and the exhaust opening in the sheet feeding direction;

a blower duct designed to feed air through the blower opening into the sheet conveyance path, having a sloping wall that changes the flow of air such that air fed through the blower opening toward the sheet conveyance path flows from the upstream side toward the downstream side in the sheet feeding direction; and an exhaust duct designed to remove the air in the sheet conveyance path through the exhaust opening and discharge the air outside of the device, having a sloping wall that changes the flow of air such that air fed from the upstream side toward the downstream side in the sheet feeding direction through the sheet conveyance path is drawn into the exhaust duct from the sheet conveyance path through the exhaust opening.

2. The sheet-conveying device according to claim 1, wherein the blower duct and the exhaust duct extend in a direction parallel to each other over the entirety of the sheet conveyance path in a sheet width direction.

3. The sheet-conveying device according to claim 1, wherein the blower opening and the exhaust opening each include a plurality of openings located in a sheet width direction.

4. The sheet-conveying device according to claim 1, wherein the blower opening and the exhaust opening comprise slits each extending in the sheet feeding direction.

5. The sheet-conveying device according to claim 1, wherein the exhaust duct has a surface sloping upwardly toward an outlet port thereof.

6. The sheet-conveying device according to claim 1, wherein the first conveyance guide includes a plurality of sheet-conveying rollers provided between the blower opening and the exhaust opening and are positioned in a sheet width direction at specific intervals; and a plurality of ventilation openings positioned between the sheet-conveying rollers.

7. The sheet-conveying device according to claim 1, wherein a cross-sectional area of an air passageway located in the blower duct is smaller than a cross-sectional area of the exhaust duct.

8. The sheet-conveying device according to claim 1, wherein the first conveyance guide is pivotably held by the device so as to expose or cover the sheet conveyance path.

9. A sheet-conveying device for feeding a sheet of paper, comprising:

first and second conveyance guides that define a sheet conveyance path, each having a conveying member designed to feed the sheet, the first conveyance guide includes a blower opening facing the sheet conveyance path for blowing air into the sheet conveyance path;

an exhaust opening provided on a downstream side in a sheet feeding direction with respect to the blower opening for removing air that has been blown into the sheet conveyance path and discharging it outside the device;

a blower duct designed to feed air through the blower opening into the sheet conveyance path, having a sloping wall that changes the flow of air such that air fed through the blower opening toward the sheet conveyance path flows from the upstream side toward the downstream side in the sheet feeding direction;

an exhaust duct designed to remove the air in the sheet conveyance path through the exhaust opening and discharge the air outside of the device, having a sloping wall that changes the flow of air such that air fed from the upstream side toward the downstream side in the sheet feeding direction through the sheet conveyance path is drawn into the exhaust duct from the sheet conveyance path through the exhaust opening; and a handle provided substantially at a center in a sheet width direction between the blower duct and the exhaust duct, the handle being operated so that the sheet conveyance path is exposed or covered.

10. An image-forming apparatus comprising;

a sheet-conveying device provided in a body of the apparatus and designed to feed a sheet fed thereto through a fixing device toward a discharge unit, comprising:

first and second conveyance guides that face each other defining a sheet conveyance path, each having a conveying member designed to feed the sheet, the first conveyance guide includes a blower opening facing the sheet conveyance path for blowing air into the sheet conveyance path;

an exhaust opening provided on a downstream side in a sheet feeding direction with respect to the blower opening for removing air that has been blown into the sheet conveyance path and discharging it outside the apparatus;

a ventilation opening provided between the blower opening and the exhaust opening in the sheet feeding direction;

a blower duct designed to feed air through the blower opening into the sheet conveyance path, having a sloping wall that changes the flow of air such that air fed through the blower opening toward the sheet conveyance path flows from the upstream side toward the downstream side in the sheet feeding direction; and an exhaust duct designed to remove the air in the sheet conveyance path through the exhaust opening and discharge the air outside of the apparatus, having a sloping wall that changes the flow of air such that air fed from the upstream side toward the downstream side in the sheet feeding direction through the sheet conveyance path is drawn into the exhaust duct from the sheet conveyance path through the exhaust opening.

11. The image-forming apparatus according to claim 10, comprising an intake fan located in the device and an exhaust fan located in the apparatus, the blower duct connects the intake fan and the blower opening to each other so that the air is fed through the blower opening into the sheet conveyance path; and the exhaust duct connects the exhaust fan and the exhaust opening to each other so that the air in the sheet conveyance path is removed through the exhaust opening.

12. The image-forming apparatus according to claim 10, wherein the sheet-conveying device is removable from a body of the apparatus.

* * * * *